United States Patent [19]

Arikawa

[11] Patent Number: 4,633,061

[45] Date of Patent: Dec. 30, 1986

[54] THERMOSTATICALLY CONTROLLED ELECTRIC SEAT HEATERS FOR VEHICLES

[75] Inventor: Tomio Arikawa, Nara, Japan

[73] Assignee: Matsushita Electric Industrial Co., Ltd., Kadoma, Japan

[21] Appl. No.: 634,108

[22] PCT Filed: Nov. 16, 1983

[86] PCT No.: PCT/JP83/00414

§ 371 Date: Jul. 18, 1984

§ 102(e) Date: Jul. 18, 1984

[87] PCT Pub. No.: WO84/01885

PCT Pub. Date: May 24, 1984

[30] Foreign Application Priority Data

Nov. 18, 1982 [JP] Japan ..... 57-175006[U]
Jul. 4, 1983 [JP] Japan ..... 58-121857

[51] Int. Cl.[4] ..... H05B 1/02; H05B 3/34; B60H 1/22

[52] U.S. Cl. ..... 219/202; 219/212; 219/217; 219/511; 219/528; 337/113

[58] Field of Search ..... 219/202, 217, 511, 211, 219/212, 528; 337/113

[56] References Cited

U.S. PATENT DOCUMENTS

| | | | |
|---|---|---|---|
| 1,074,215 | 9/1913 | Schuirmann | 337/113 X |
| 1,522,122 | 1/1925 | Heidbrink et al. | 219/511 X |
| 1,610,915 | 12/1926 | Allen | 337/113 |
| 1,689,004 | 10/1928 | Ackley | 219/511 X |
| 2,520,851 | 8/1950 | Myers et al. | 219/212 |
| 2,537,376 | 1/1951 | Smith | 219/212 |
| 3,096,424 | 7/1963 | Cecchini | 219/511 X |
| 4,335,725 | 6/1982 | Geldmacher | 219/202 X |

FOREIGN PATENT DOCUMENTS

| | | | |
|---|---|---|---|
| 40-7927 | 3/1965 | Japan . | |
| 51-141209 | 11/1976 | Japan . | |
| 54-28438 | 3/1979 | Japan . | |
| 7511493 | 4/1976 | Netherlands | 219/202 |

*Primary Examiner*—A. Bartis
*Attorney, Agent, or Firm*—Cushman, Darby & Cushman

[57] ABSTRACT

A vehicle seat heater includes a main body adapted to be mounted on at least one of a seat cushion part or seat back part of a vehicle seat and provided with a pair of electric warming heaters. A thermally insulated temperature control unit located remotely from the heater main body is provided for stopping energization of the heating elements when the temperature of the seat heater main body exceeds a predetermined level. The control unit includes a pair of auxiliary electric heaters each respectively coupled to a different one of the warming heaters for simultaneous energization therewith and a pair of thermostatic switches coupled in series, with each thermostatic switch being in heat exchange relationship with a different one of the auxiliary heaters for stopping the flow of electricity to the auxiliary heater and warming heater coupled thereto. The thermostat switches and auxiliary heaters are disposed within casing or housing and connected to the respective warming heaters by lead wires.

3 Claims, 14 Drawing Figures

Fig. 11a
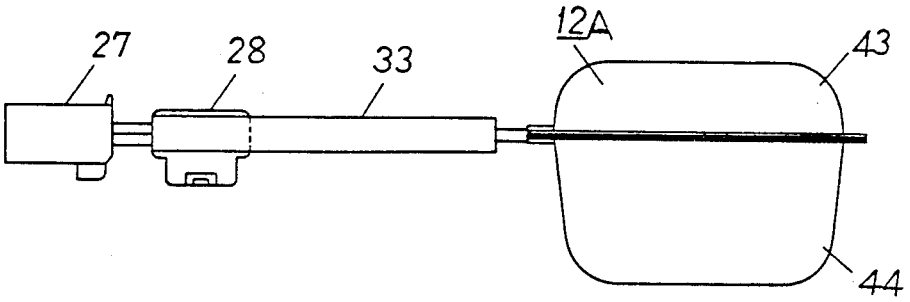
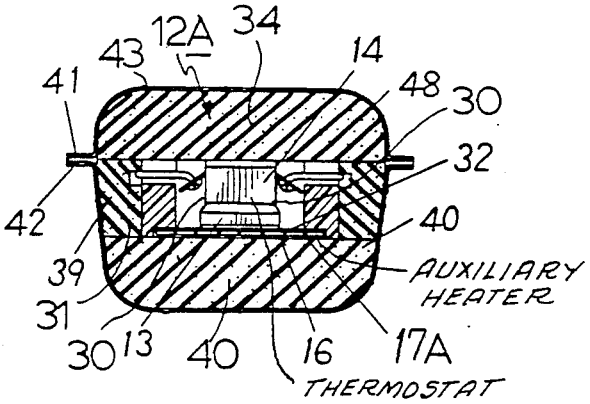
Fig. 11b

THERMOSTATICALLY CONTROLLED ELECTRIC SEAT HEATERS FOR VEHICLES

TECHNICAL FIELD

This invention relates to a vehicle seat heater which is to be mounted on a seat cushion part and/or a seat back part of a vehicle seat.

BACKGROUND ART

In the conventional vehicle seat heater as shown in FIG. 1 and FIG. 2, seat heater main body 4 is constructed by wiring cord-shaped warming heater 2 in zig zag shape on substrate body 1 consisting of a polyester non-woven fabric, or the like, and by heat-press-bonding (or a similar process) surface cloth 3, which has a thermal fusing adhesive, on both sides of the substrate body 1. On one part of the seat heater main body 4, a thermostat 5 is mounted to directly sense the heat of the seat heater warming part 4'. Lead wires 6 are connected to the thermostat 5 and the above-mentioned warming heater 2, and connection plug 7 for connecting the vehicle seat heater to a power source (not shown) of an automobile. The above-mentioned seat heater main body 4 is, as shown in FIG. 3, mounted on a seat part 8*a* and a seat back part 8*b* of a vehicle seat 8. The above-mentioned mounting of the seat heater main body is made, as shown in FIG. 4, by inserting and disposing heater main body 4 between a pad 9 formed of foamed urethane and a cushion material 10 made of foamed urethane. Incidentally, numeral 11 is the surface leather of the vehicle seat.

In the above-mentioned configuration, however, since thermostat 5, which controls the flow of electricity to the heater 2 by detecting the temperature of the warming heater 2, is mounted on one part of the seat heater main body 4, and the seat heater main body 4 is mounted in the vehicle seat 8, the thermostat 5 causes a bump to be formed in the seat surface, and as a result, the user feels uncomfortable when sitting on the vehicle seat.

A solution has been proposed which mounts the thermostat in a part of the seat not touching the user, namely at the part where the seat cushion part 8*a* and the seat back part 8*b* are superposed, or mounting it between the legs of the user. However, these solutions require thermostat temperature settings unique to each vehicle seat shape, since heating characteristics vary depending on respective vehicle seat configurations due to the shape of the vehicle seat 8 and the shape and volume of the cushion material 10. Therefore, mounting the thermostat in such locations has been troublesome.

SUMMARY OF THE INVENTION

In view of the above-mentioned problems, the present invention provides a vehicle seat heater which has no uncomfortable feeling when the user is seated on the seat, and is capable of stably controlling the warming heater independent of the shape and construction of the vehicle seat. In order to achieve this purpose, the present invention covers the control part, the auxiliary heater and the thermostat with heat insulation material, and also disposes the control part separate from the seat heater main body and at a location other than the seat cushion part and seat back part of the vehicle seat. By this configuration, there is no uncomfortable feeling when the user is seated on the vehicle seat. Since the control part is not positioned in the vehicle seat, there is no need to temperature set the control part to take into account variations in the shapes of vehicle seats.

BRIEF DESCRIPTION OF THE DRAWINGS

FIG. 11*a* and FIG. 11*b* are, respectively, a side view of the control device and a cross-sectional view of FIG. 10 taken along line 11*b*—11*b* of FIG. 10.

DETAILED DESCRIPTION OF THE PREFERRED EMBODIMENT

Figure 1:
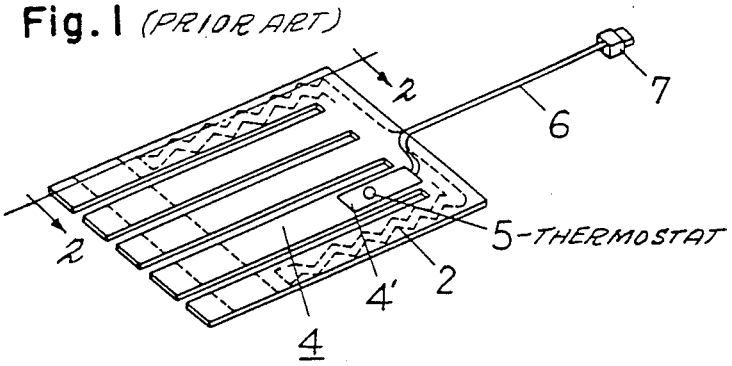
Fig. 1 (PRIOR ART)
FIG. 1 is a perspective view showing the conventional seat heater for vehicle.
Figure 2:
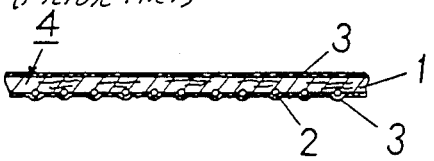
Fig. 2 (PRIOR ART)
FIG. 2 is a cross-sectional view taken along line 2—2 of FIG. 1.
Figure 3:
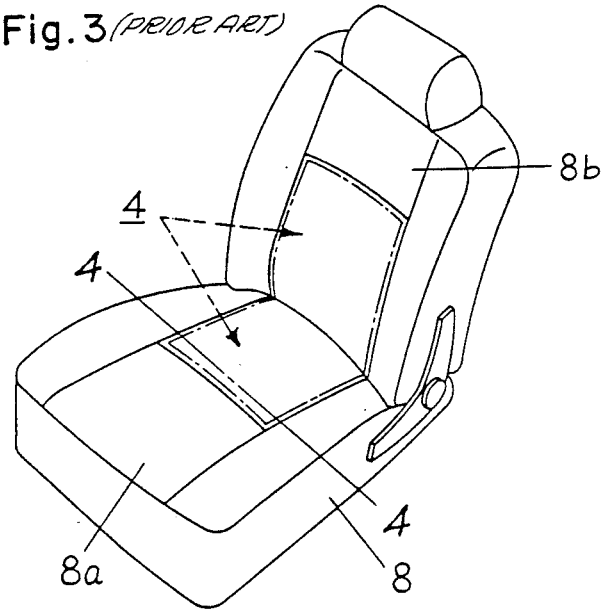
Fig. 3 (PRIOR ART)
FIG. 3 is a perspective view of the vehicle seat provided with the seat heater of FIG. 1.
Figure 4:
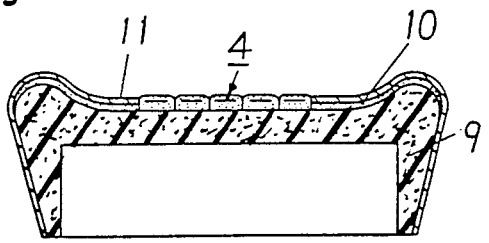
Fig.4 (PRIOR ART)
FIG. 4 is a cross-sectional view taken along line 4—4 of FIG. 3.
Figure 5:
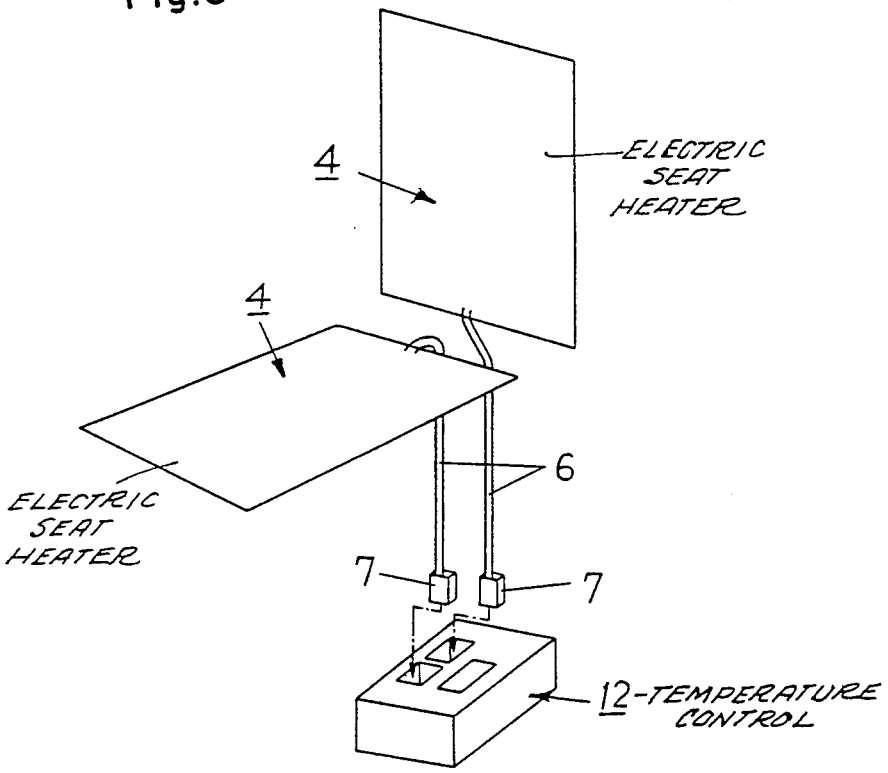
FIG. 5 is an exploded perspective view of a vehicle seat heater showing one embodiment of the present invention.
Figure 6:
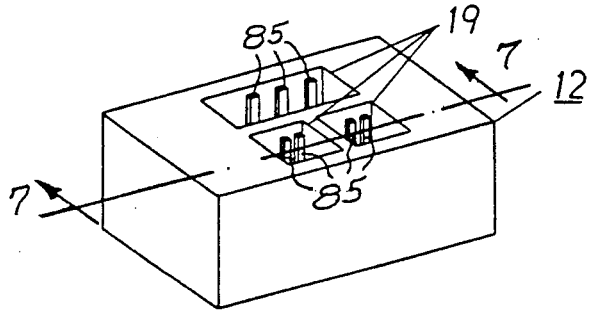
FIG. 6 is a perspective view of a control part in the seat heater of FIG. 5.
Figure 7:
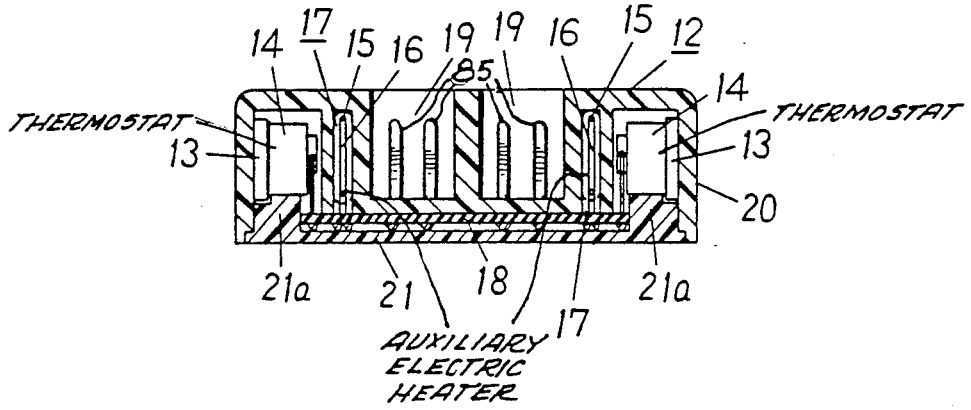
FIG. 7 is a cross-sectional view of the control part of FIG. 6 taken along line 7—7 of FIG. 6.

On embodiment of this invention will now be described in connection with FIG. 5 through FIG. 8. Incidentally, in FIG. 5 through FIG. 8, the same numbers as those shown in FIG. 1 through FIG. 4 are used for like components. That is, in this emboidment, lead wires 6 (which are connected to warming heater 2) are led out from a pair of seat heater main bodies 4 (which are mounted on the seat cushion part 8*a* and seat back part 8*b* of the vehicle seat 8), and connection plugs 7 are provided at end parts of the lead wire 6, and a control part 12 (to which the connection plugs 7 are detachably mounted and which controls the supply of electricity to the heater depending upon the temperature of the warming heater 2) is provided. The control part 12, as shown in FIG. 6 and FIG. 7, includes thermostats 14 having temperature sensing parts 13, auxiliary heaters 17 disposed at adjacent positions to the thermostats 14 and constituted by winding heater material around a holding body 16, and a case 20 wherein auxiliary heaters 17 and the above-mentioned thermostats 14 are mounted. Auxiliary heaters 17 and thermostats 14 are mounted on a holding sheet 18 formed by a printed circuit substrate. Plug reception parts 19 are provided in which the connection plug 7 at the end parts of lead wires 6 are detachably mounted. Terminal pins 85 are provided within reception parts 19 to make electrical contact with terminal sockets on plugs 7 (not shown). A case lid 21 is provided for closing a bottom opening of the case 20 and comprises protrusion parts 21*a* which abut the thermostats 14. The case 20 and the case lid 21 are of heat insulation material, and the temperature sensing part 13, thermostats 14, and auxiliary heater 17 are covered by case 20 and lid 21. Also, the above-mentioned thermostats 14 are mounted in the case 20 in such a manner that the temperature sensing parts 13 abut the inside face of the case 20, and the auxiliary heaters 17 are disposed to heat parts of case 20 located opposite the temperature sensing parts 13 of the thermostats 14.

Figure 8:
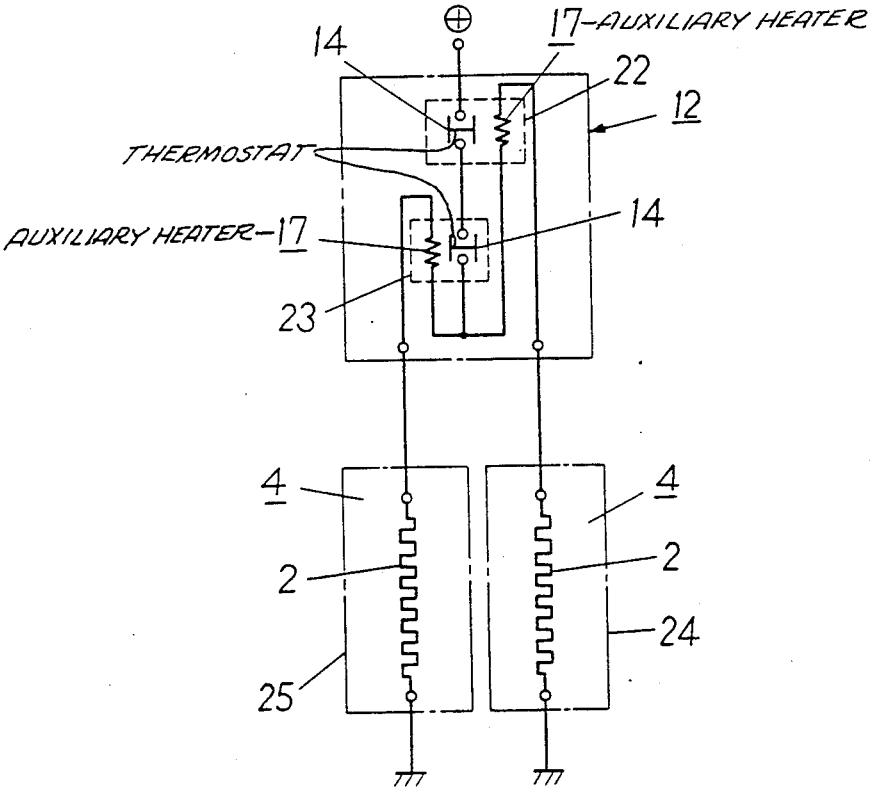
FIG. 8 is a circuit diagram of the seat heater of FIG. 5.

FIG. 8 shows a circuit diagram, wherein two thermostats 14 are connected in series, and the auxiliary heaters 17 are disposed adjacent to respective ones of thermostats 14 to constitute thermostat-auxiliary heater units 22 and 23. Furthermore, the above-mentioned auxiliary heaters 17 and a pair of warming heaters 2 are connected in series respectively by connecting members. Incidentally, the each series connected pair of warming heaters 2 and the auxiliary heaters 17 are respectively connected in parallel.

Seat cushion part sheet heater 24 is mounted to the seat cushion 8*a* of the vehicle seat 8 and is connected to one thermally connected thermostat-auxiliary heater unit 22. Seat back part sheet heater 25 is mounted at the seat back part 8*b* of the vehicle seat 8 and is connected to the other thermostat-auxiliary heater unit 23. Thus, even if one sheet heater is broken, the other thermostat-auxiliary heater unit operates normally. Furthermore, since the two thermostats 14 are connected in series, the current flows through the two thermostatic stages, and accordingly a double safety circuit is realized.

Figure 9:
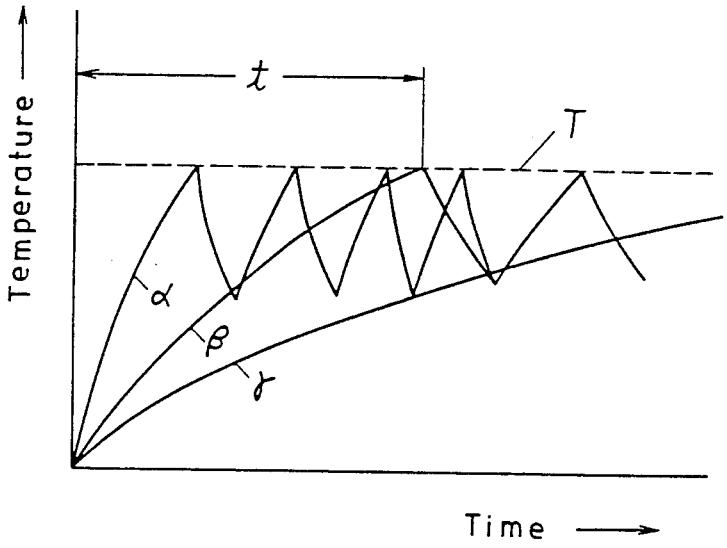
FIG. 9 is a temperature vs. time characteristic chart of the seat heater of FIG. 5.

In this embodiment, control part 12 which is constituted by thermostats 14 or the like, which stop the flow of electricity to the warming heater 2 when the temperature of the heater 2 reaches a preset temperature, is covered by heat insulation material as above-mentioned. Control part 12 is also disposed separate from the pair of sheet heaters 24 and 25 of main body 4 which are mounted on the seat cushion part 8*a* and seat back part 8*b* of the vehicle seat 8. Control part 12, may be placed in a space below pad 9 of FIG. 4. As a result, there is no protrusion in the seat and thus no uncomfortable feeling when the user is seated on the vehicle seat 8, unlike the prior art where the thermostats are disposed on the vehicle seat. Furthermore, the above-mentioned control part 12 is not affected by the influence of the shape and constitution of the vehicle seat 12, nor the thermal influence by heat capacity of the pad 9 shown in FIG. 4. Therefore, a thermo-timer which switches on-off at time interval t, as shown by $\beta$ of FIG. 9, may be obtained. That is, T of FIG. 9 shows the preset desired temperature, and $\alpha$ shows a characteristic heating curve where the time from the beginning of the rise of temperature to achieving the present temperature is short. Curve $\alpha$ is not desirable since heating is too rapid. Curve $\gamma$ of FIG. 9 shows a characteristic curve of the thermostat in which temperature rises more slowly so that to reach the preset temperature T requires a great deal of time. Therefore, the time-temperature presetting as shown in $\beta$ of FIG. 9 is needed. In the present invention, as a result of the above-mentioned configuration, the characteristic curve as shown by $\beta$ of FIG. 9 is obtainable. According to actual experiments, results have been obtained in which energizing the heating elements for 30 minutes to 1 hour in case the temperature outside the vehicle is −20° C., provides a sufficient warmth to the seat. In such a case, even though the vehicle seat is warmed at this rate, the temperature does not reach a dangerous temperature. It is preferable that the case wattage density of the seat heater main body 4 should be 220–226 W/m2.

Figure 10:
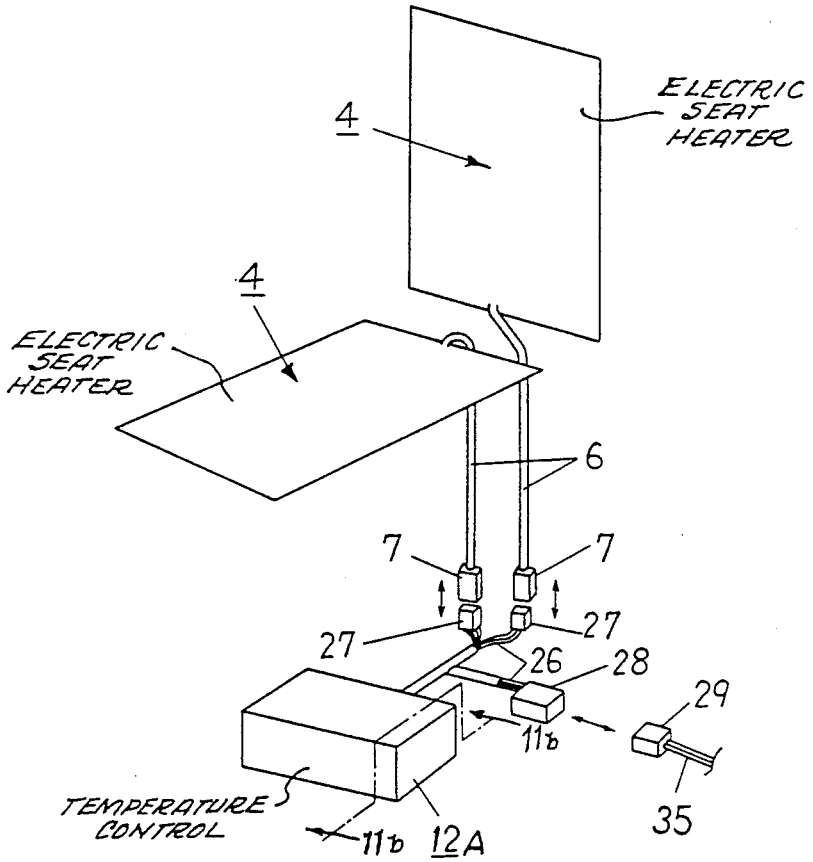
FIG. 10 is an exploded perspective view of the seat heater showing another embodiment of the present invention.
Figure 12:
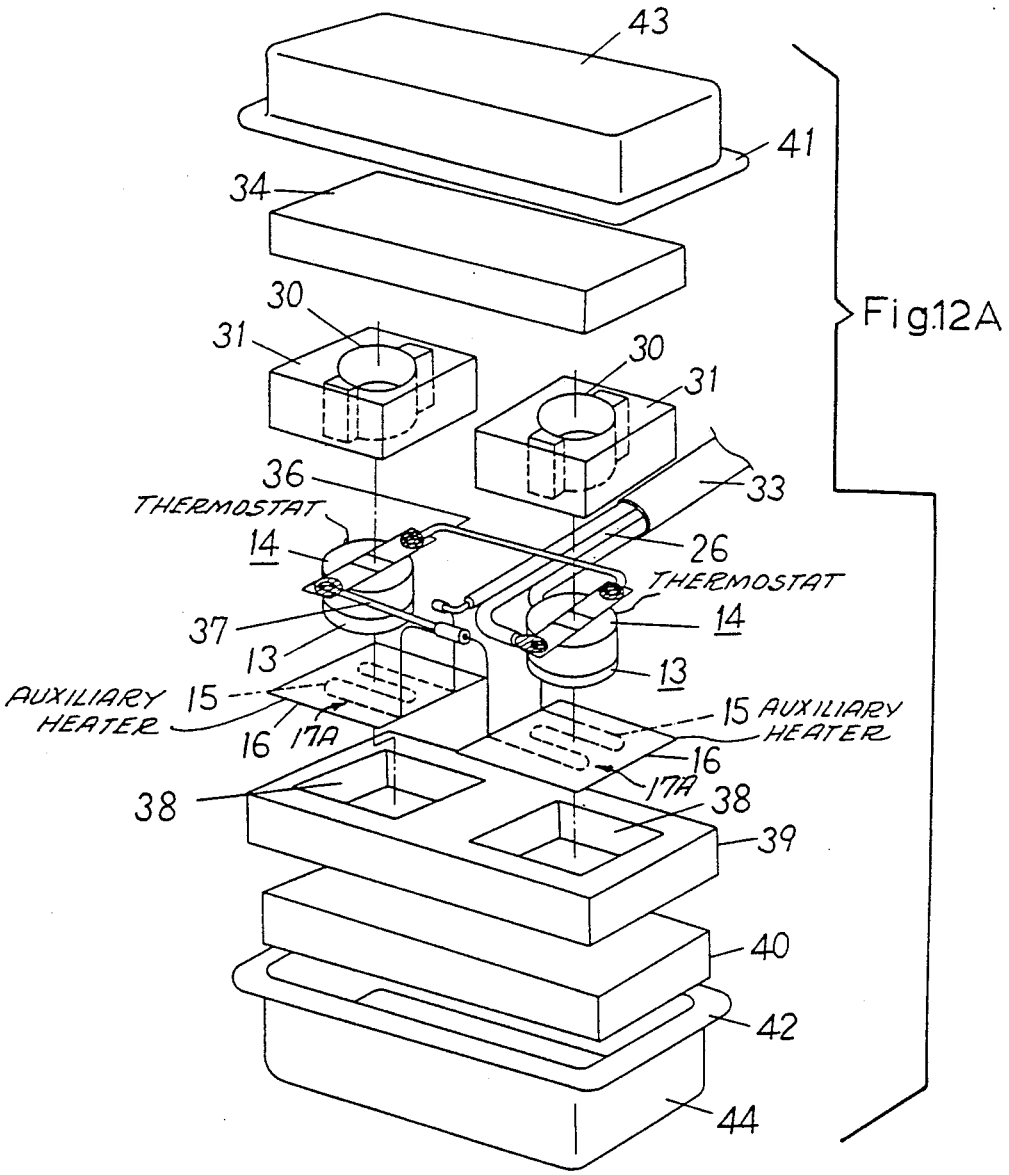
FIG. 12 is an exploded perspective view of the control device of FIG. 10.

Next, another embodiment of this invention is described with the reference to FIG. 10. A connection plug 27 is provided on end parts of lead wires 26 which are led out from the control part 12A, and plug 27 is detachably connected to the connection plug 7 which led out from sheet heater main body 4. Also, lead wires 26 from control part 12A are connected to vehicle power through connection plug 28, vehicle plug 29 and vehicle power lines 35. As shown in FIGS. 11*a*, 11*b* and 12, control part 12A is made by first making auxiliary heater 17A (used for thermostat heating) by heat pressing heaters 15 to holding body 16 which is made of non-woven fabric or the like, and to non-flammable fabric 32. Holding bases 31 are provided having holes 30 for inserting the thermostat 14. Next, thermostats 14 (having temperature sensing parts 13) are inserted in the holes 30 of the holding bases 31 so that sensing parts 13 face the auxiliary heater 17A for thermostat heating, thereby one face of the holes 30 are closed. Also, the heaters 15 and the thermostats 14 are connected by lead wires 36 and 37.

Next, the assembly of control part 12A is completed by placing a covering member 39 having square holes 38 for inserting the holding bases 31, over the auxiliary heater-thermostat assembly and covering members 34, and 40 are abutted from upper and lower sides. Synthetic resin cases 43 and 44 having flange planes 41 and 42, are fitted over the entire assembly. The flange planes 41 and 42 thus fitted are joined and all peripheries are welded by high frequency welding or a like process.

At this time, lead wires 26 are led out of the casing. Also, a tube 33 for protecting the lead wires 26 is connected to the lead wires 26. Thus, in this embodiment also, the temperature sensing part 13, thermostats 14 and auxiliary heater 17 are covered by heat insulation material such as the above-mentioned covering members 34, 39, 40 and is disposed beneath pad 9 of the vehicle seat. Also, the electric circuit of this control part 12A is as shown in FIG. 8. Also, in the control part 12A, the temperature rise characteristic curve of the thermostat 14 is determined by the heat capacity and heat keeping capability of the thermostats 14 and environment surrounding the thermostats and not the vehicle seat. Of course, however, the characteristic curve should be considered to be dependent on the ambient temperature. In order to obtain sufficient warming characteristics, the heat retention capacity of control part 12A should be increased by means of the holding bases 31 having a high heat retention capacity, thereby raising the temperature slowly by appropriate control of the auxiliary heater 17A, and by retaining heat by appropriate choice of covering members 34, 39 and 40. With only the heat retention capacity of the thermostats 14, the heating characteristic curve becomes like $\alpha$ of FIG. 9, and unless heat retention capacity of the heater is carefully chosen, the characteristic curve will become like $\alpha$ or $\gamma$. Furthermore, unless an appropriate choice of covering members 34, 39 and 40 is made, the characteristic curve becomes like $\gamma$. Also, the heat retention capacity of control part 12A can be determined by a product of weight and specific heat. According to experiments, the weight of the thermostats 14 and the weight of the holding bases are, in total, preferably 20–25 g, and the auxiliary heater 17A is preferably supplied with about 1 W–2 W, and the thickness of urethane foam covering members 34, 39 and 40 is preferably 8–15 mm each when piled in three layers. Thereby, appropriate characteristic curve $\beta$ of FIG. 9 has been obtained.

The embodiments described in FIG. 5 through FIG. 12 have the following effects:

(a) Since two thermostatic stages are connected in series, current flows through two stages of the thermostats 14, thereby a double safety circuit can be obtained;

(b) Since each warming heater 2 is connected in series with a thermostat 14 and an auxiliary heater 17, and the two thermostat-warming heater assemblies are connected in parallel, even if one of the warming heaters 2 is cut off and one thermostat 14 does not operate, the other thermostat operates normally and a state of extraordinary overheating or burning out of an element or a like danger does not take place;

(c) Since the control part 12 or 12A is separated from the warming heater 2 and the thermostats 14 are not provided in the seat as the prior art, there is no uncomfortable feeling when the user is seated;

(d) Maintenance is simplified since the control part 12A can be easily replaced by disconnecting/connecting the connection plugs 7, 27 and 28; and (e) Since temperature setting of the thermostats 14 is now unnecessary, even if a cushion, thick seat cover, cloths or the like are left on the seat during the ON state of the warming heater 2, extraordinary overheating or burning or the like can be prevented.

As above-mentioned, according to the present invention, there is no uncomfortable feeling when the user is seated on the vehicle seat, since controlling parts such as the thermostats are not disposed on the vehicle seat as in the prior art. Also, even if there are variations in the shape or configuration of the vehicle seat, there is no need to individually set the temperature of the control part such as a thermostat to correspond to the seat configuration, as required in the prior art. Furthermore, even if a cushion, thick seat cover, cloths or the like are left on the vehicle seat at the ON state of the warming heater, an overheating condition will be prevented since the control parts such as the above-mentioned thermostats are configured to stop supplying electricity to the heater when the temperature of the warming heater exceeds the present temperature. Thus, the present invention provides a vehicle seat heater which operates in a stable state and has increased safety.

Furthermore, since the heat retention capacity and temperature keeping state of the thermostats and elements surrounding the thermostats can always be kept constant, there is no thermal influence on the thermostats by the shape, size and configuration of the seat cushion part and the seat back part of the seat, and a seat heater having a constant characteristic curve is obtainable, thus making operation of the vehicle seat heater highly reliable and safe.

I claim:

1. A vehicle seat heater comprising:

a seat heater main body adapted to be mounted on at least one of a seat cushion part and a seat back part of a vehicle seat, said seat heater main body including a pair of electric warming heaters;

temperature control means for stopping the flow of electricity to said electric warming heaters when the temperature of said seat heater main body exceeds a predetermined level, said control means being covered by a heat insulation material and adapted to be disposed at location separate from said seat heater main body, said control means including:

a pair of auxiliary heaters each respectively coupled to a different one of said pair of electric warming heaters and adapted to be energized and deenergized simultaneously with the associated electric warming heater, said auxiliary heaters being covered by said heat insulation material; and a pair of thermostatic switches coupled in series, each thermostatic switch being in heat exchange relationship with a different one of said auxiliary heaters, for stopping said flow of electricity to said warming heater and said auxiliary heaters; said thermostatic switches being covered by said heat insulation material; and coupling means for coupling said thermostatic switches to said electric warming heaters.

2. A vehicle seat heater according to claim 1 wherein said coupling means includes lead wires each having a first end with at least one connection plug for connection to said control means, and wherein each said thermostatic switch includes a sensing member for sensing temperature, and wherein said control means includes:

a casing for holding said thermostatic switches and said auxiliary heaters so that each said sensing member abuts a wall of said casing and said auxiliary heaters are disposed internal to said casing to cause said casing to be heated simultaneously with said electric warming heaters; and at least one receptacle centrally disposed in said casing for receiving said connection plug.

3. A vehicle seat heater according to claim 1 wherein each said thermostatic switch includes a sensing member for sensing temperature, and wherein said coupling means includes lead wires each having a first end coupled in series with a respective on of said thermostatic switches and the associated auxiliary heater, and wherein said control means includes:

said heat insulation comprising at least one heat insulating member surrounding said thermostatic switches and said auxiliary heaters, and said at least one insulating member holding said thermostatic switches and said auxiliary heaters in such a manner as to cause each said sensing member to closely abut an associated one of said auxiliary heater; and a housing for holding said at least one heat insulating member and said thermostatic switches and said auxiliary heaters in assembled relationship.

* * * * *